US005279335A

United States Patent [19]

Bassi

[11] Patent Number: 5,279,335

[45] Date of Patent: Jan. 18, 1994

[54] DEVICE FOR ASSEMBLING A PLURALITY OF HARNESS CORDS

[75] Inventor: Dario Bassi, Venissieux, France

[73] Assignee: Staubli-Verdol S.A., Chassieu, France

[21] Appl. No.: 989,325

[22] Filed: Dec. 11, 1992

[30] Foreign Application Priority Data

Dec. 20, 1991 [FR] France ..... 91 16201

[51] Int. Cl.[5] ..... D03C 3/40

[52] U.S. Cl. ..... 139/59; 139/85; 24/616; 403/329

[58] Field of Search ..... 403/329; 24/3.13, 115.14, 129 A, 616; 139/88, 139/59, 85

[56] References Cited

U.S. PATENT DOCUMENTS 4,513,789 4/1985 Bowen, Jr. et al. ..... 139/85
4,815,174 3/1989 Sou ..... 24/171 X

FOREIGN PATENT DOCUMENTS 2315968 10/1974 Fed. Rep. of Germany ..... 139/85
250341 10/1987 German Democratic Rep. ... 139/85

*Primary Examiner*—Andrew M. Falik
*Attorney, Agent, or Firm*—Dowell & Dowell

[57] ABSTRACT

A device for assembling a plurality of cords which includes a bushing having a bore which cooperatively receives a clamp. The bushing includes an opening through which adhesive may be introduced after the clamp is inserted within the bore of the bushing to thereby bind the cords which are initially carried by the clamp. The clamp includes two branch elements joined by a crosspiece. Each branch element includes a first outwardly directing hooked end, a second inwardly directed jaw portion and an intermediate outwardly projecting portion. The intermediate portions are yieldably compressible with respect to one another to permit the insertion of the clamp in the bore of the bushing.

13 Claims, 4 Drawing Sheets

DEVICE FOR ASSEMBLING A PLURALITY OF HARNESS CORDS

BACKGROUND OF THE INVENTION

1. Field of the Invention

The present invention relates to a device for assembling a plurality of cords and more particularly, but not exclusively, to the assembling of the cords of a harness for a weaving loom.

2. History of the Related Art

A number of systems for assembling a plurality of cords is known, such as the one described for example in Belgian Patent BE-A-83 4747 which provides that the upper ends of a group of wires are connected to a sheath of thermoplastic material which is molded on the wires. Document FR-A-90 02467 also discloses a system whereby the cords of the harness are associated with a tubular member engaged in a bushing so that the cords are retained by abutment of the lower end of the tubular member against an annular base of the bushing.

It is an object of the present invention to improve the known systems of assembly so that they can be rendered automatic, while ensuring a particularly efficient retention of the cords and so that their cost is decreased.

SUMMARY OF THE INVENTION

To that end, the device according to the invention includes:

a tubular bushing having a wall with a radial hole providing communication between an open bore and the outside of the bushing;

a clamp having two branch elements approximately parallel with respect to each other and joined by a crosspiece. Each branch includes at one of its ends a hook which is oriented outwardly of the bushing and at its opposite end a jaw element oriented in a direction opposite to that of the hooked ends. In addition the branch elements are provided with a projection oriented in the same direction as that of the hooked ends and disposed between the crosspiece and the jaw elements.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
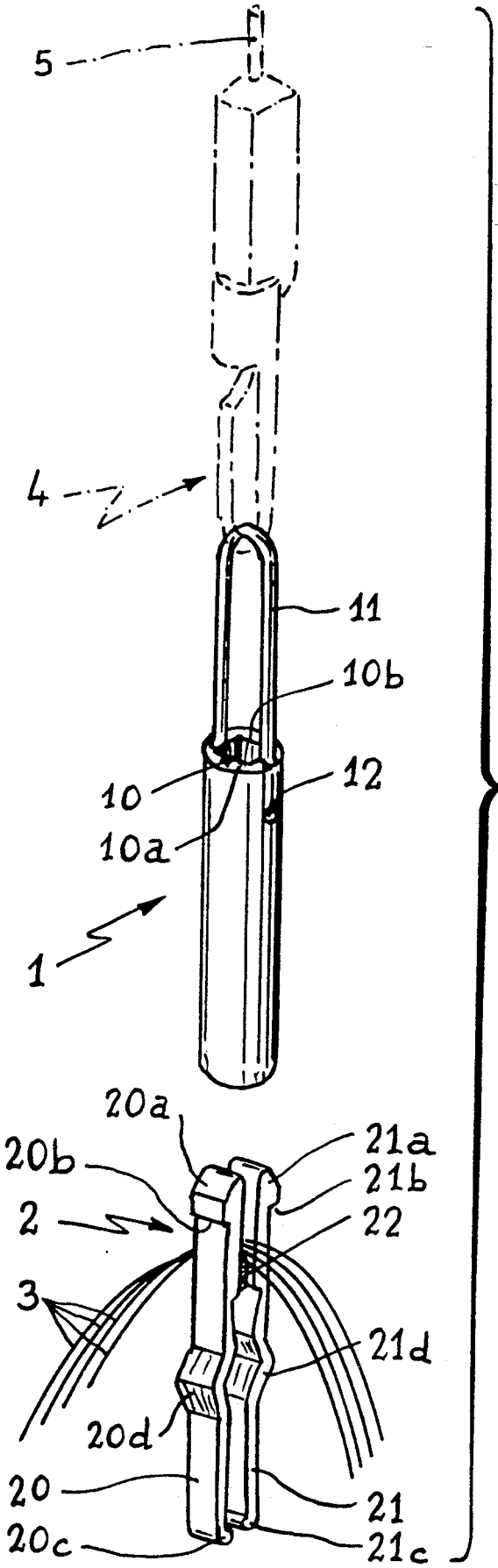
FIG. 1 is an exploded view in perspective of a device according to the invention.

Referring now to the drawings, FIG. 1 shows a device according to the invention essentially comprising a tubular bushing 1 having a bore 10 and a handle 11 and a clamp 2. The device according to the invention is provided to retain a certain number of cords 3 which, in the example shown, are the cords of a harness intended for opening the shed of a weaving loom.

The handle 11 of the tubular bushing 1 is associated with a snap fastener 4 secured to the lower end of a funicular element or cord 5 forming part of a mechanism for forming the shed and to which a reciprocating movement is imparted.

The clamp 2 is made in the form of two branch elements 20, 21 disposed substantially parallel with respect to each other and which are joined by a crosspiece 22.

One of the ends of each branch element 20, 21 of the clamp 2 is made in the form of a hook **20*a*, 21*a* of which the hooking tip 20*b*, 21*b* is oriented towards the outside, i.e. opposite the plane of symmetry of the clamp 2. The other end of each branch element is provided with a jaw 20*c*, 21*c* oriented opposite to the tips 20*b*, 21*b***, i.e. facing the inside of the clamp.

Each branch element is bent outwardly in a zone located at about $\frac{1}{3}$ of its total length with respect to the jaw. A projection **20*d*, 21*d* is thus constituted, oriented in the same direction as that of the hook tips 20*b*, 21*b*. Of course, this projection lies between the crosspiece 22 and the corresponding jaw. It will be observed that, to render the two branches of the clamp 2 supple or resiliently yieldable, the crosspiece 22 is spaced from hooks 20*a*, 21*a*** by a distance equal to about $\frac{1}{3}$ of the total length of the branch elements.

The transverse section of the clamp 2 is rectangular, i.e. the distance between the outer faces of the branch elements 20, 21 is greater than their thickness.

The bore 10 of the bushing 1 has a cross section similar to that of the clamp 2, so that the clamp can be engaged in the bushing only with the free space defined between the branch elements 20, 21 and corresponding to the thickness of the crosspiece 22. A hole 12 is made in the wall of the bushing 1 and communicates the bore with the outside.

Connection between the cords 3 is effected in the following manner:

Cords 3 are firstly engaged around the crosspiece 22 so that each forms a loop parallel to the branch elements of the clamp and disposed therebetween.

Figure 2:
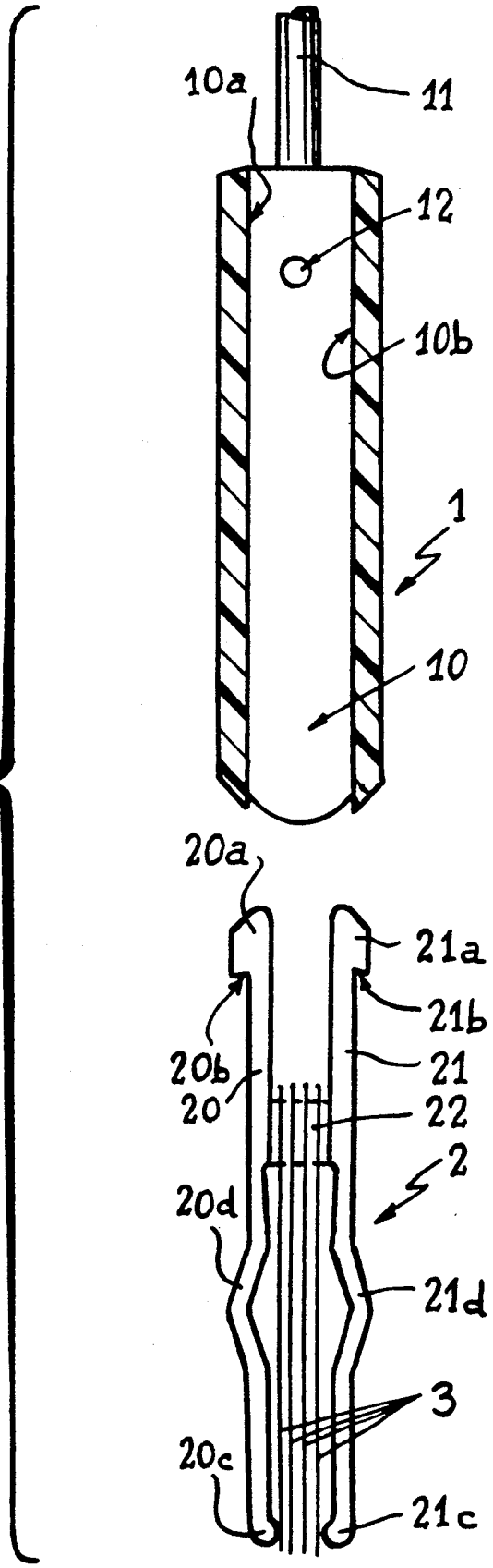
FIG. 2 is a longitudinal cross section assembly view through the bushing and showing the clamp according to the invention.
Figure 3:
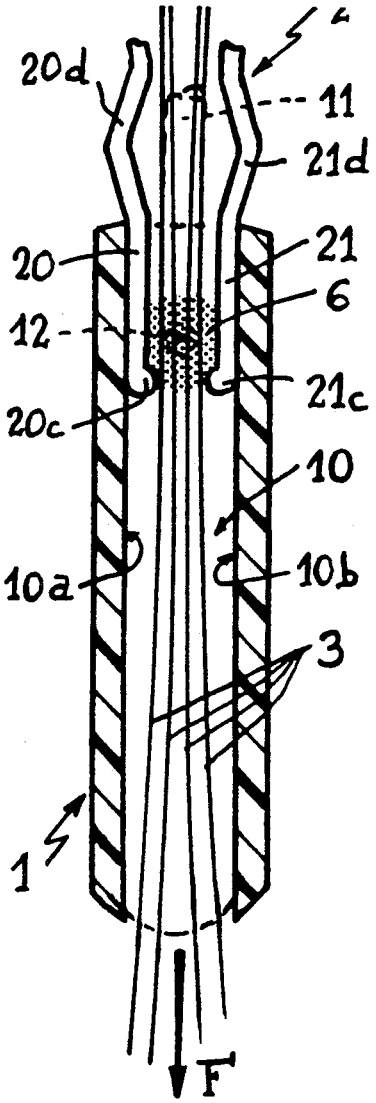
FIG. 3 is a partial cross-sectional view which illustrates the position of the clamp with respect to the bushing when glue is poured between the branches of the clamp inside the bushing.

Then, by an appropriate system the clamp is engaged in the bore 10 of the bushing. The hooks **20*a* and 21*a* are tightened or compressed and, from the position of FIG. 2, the clamp 2 is forced into the bushing until it comes into the position illustrated in FIG. 3. In the position of FIG. 3 it will be noted that projections 20*d*, 21*d* are located just above that end of the bushing which carriers the handle 11. Those parts of the branch elements 20 and 21 included between the projections and the jaws abut against the corresponding faces 10*a*, 10*b* of the bore 10. It is noted that the opening of the hole 12 is then located inside the clamp slightly above the jaws 20*c*, 21*c*. A certain quantity of cyano-acrylate glue or the like is then poured through hole 12** from the outside to coat all the cords disposed between the two branch elements of the clamp.

Figure 4:
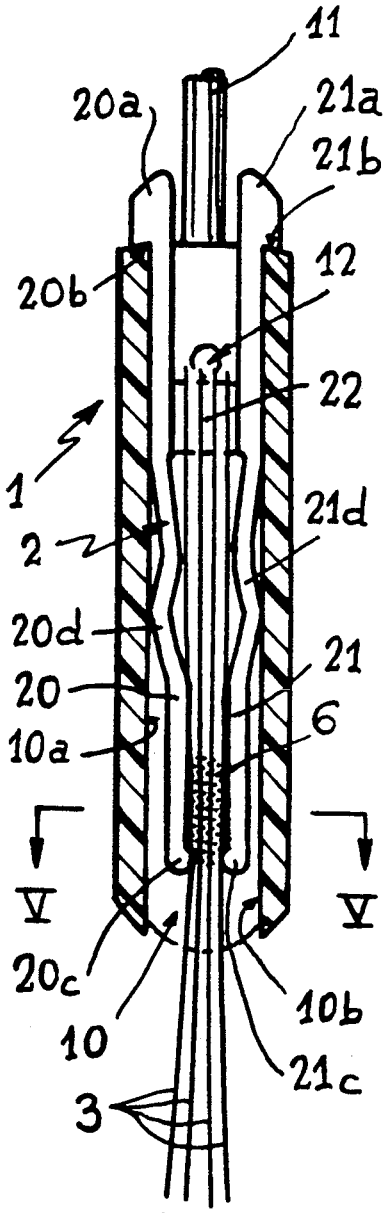
FIG. 4 is a longitudinal section illustrating the definitive assembled position of the two elements of the device according to the invention.
Figure 5:
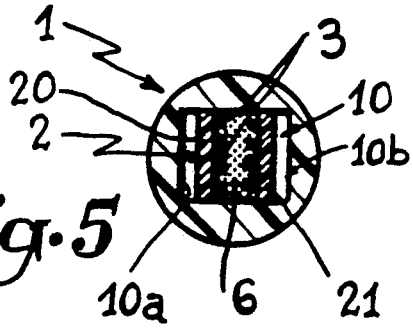
FIG. 5 is a section along V—V (FIG. 4).

The last operation consists in exerting a forces in the direction of arrow F of FIG. 3 on all the cords 3 to bring the clamp into the position of FIG. 4, with the tips **20*b* and 21*b* of the hooks in abutment against the annular face of the bushing 1 from which the handle 11 extends. This introduction causes the jaws 20*c*, 21*c* to tighten due to the cooperation of the projections 20*d*** and 21*d* with the opposite faces 10*a*, 10*b* of the bore 10 of the bushing 1, so that the glue is compressed to form with the cords 3 a heterogeneous mass 6, so that the cords are connected together in non-destructible manner.

Of course, the system of connecting the bushing 1 with the funicular element or cord 5 may be of any type: for example, the bushing may form part of one of the elements of a device for assembling the cords 3 with the funicular element 5.

Figure 6:
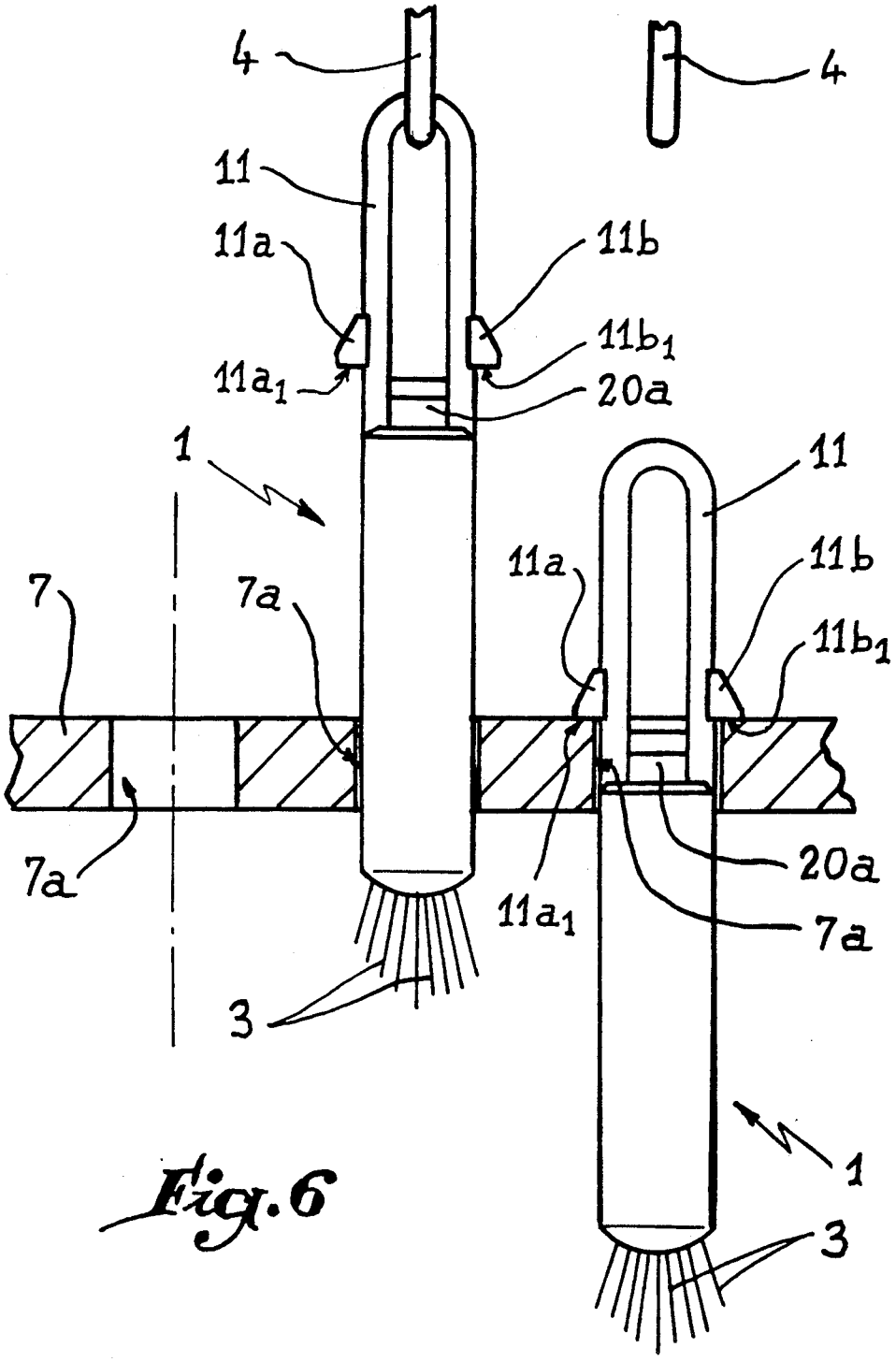
FIG. 6 illustrates another embodiment of the device according to the invention.

FIG. 6 illustrates another embodiment of the assembling device according to the invention, on the one hand in low position in the course of functioning and, on the other hand, in position separate from a snap 4. According to this embodiment, the two branch elements of the handle 11 each have an outwardly projecting lug 11*a*, 11*b*. These lugs each have a downwardly facing horizontal face 11*a*1, 11*b*1.

The cords 3 are guided in conventional manner in the holes 7*a* in a horizontal plate 7 above which the devices 1–2 according to the invention move to and fro without ever traversing the holes.

If device 1–2 is disconnected from the snap 4, the faces 11*a*1 and 11*b*1 of lugs 11*a*, 11*b* come to rest against the plate 7 on the edge of its holes. The harness is thus automatically maintained.

It is observed that the diameters of the holes and the thickness of the lugs are such that, by forcing the branch elements of the handle 11 together, each device 1–2 may be passed through the corresponding hole 7*a* of the plate 7, for example to disassemble the harness.

In particular, the two elements of the device according to the invention may be made of any appropriate material giving the required elasticity to the branch elements of the clamp 2. These elements are preferably made of a plastic material such as "NYLON" or the like.

What is claimed is:

1. A device for assembling a plurality of cords comprising, a bushing having an outer wall defining a bore, an opening through said wall communicating said bore exteriorly of said bushing, a clamp having two branch elements approximately parallel with respect to each other and extending on opposite sides of an axis of symmetry taken along said clamp, said branch elements being joined by a crosspiece, each branch element having a first hooked end, a second jaw end and an intermediate portion, said hooked ends being oriented outwardly with respect to said axis of symmetry, said jaw elements being oriented inwardly with respect to one another and toward said axis of symmetry, and a projection formed along said intermediate portion of each of said branch elements, said projections being oriented outwardly with respect to said axis of symmetry and being disposed between said crosspiece and said jaw elements.

2. The device of claim 1, wherein the bore of said bushing is generally rectangular having a first dimension, said clamp having a transverse section corresponding to said first dimension so as to be cooperatively seated within said bore.

3. The device of claim 2, wherein said bushing has upper and lower ends, said opening extending through said outer wall adjacent said upper end so as to communicate with an area defined between said jaw elements of said branch elements when said jaw elements extend inwardly of said bore and said projections engage said upper end of said bushing.

4. The device of claim 1, wherein said bushing includes means for connecting said bushing to a funicular element.

5. The device of claim 4, wherein the plurality of cords are the cords of a harness of a shed-forming mechanism of a weaving loom, said means for connecting said bushing with a funicular element including a handle means extending from said bushing and fastener means connected to said funicular element for engaging said handle means.

6. The device of claim 1, wherein said branch elements are constructed of a resiliently yieldable material.

7. The device of claim 1, including a handle means extending from said bushing, said handle means including a pair of spaced portions, a projecting lug extending outwardly from each of said spaced portions.

8. The device of claim 7, including a plate means having an opening therein, said opening being of a first dimension, said bushing being of a size to be inserted through said opening, said lugs having contact surfaces for engaging said plate means on opposite sides of said opening whereby said lugs support said bushing within said opening.

9. The device of claim 8, wherein said spaced portions of said handle means are resiliently yieldable toward one another so that upon application of force applied to compress said spaced portions towards one another said lug means are drawn inwardly so as to pass through said opening in said plate means.

10. A device for assembling a plurality of cords of a harness of a shed-forming mechanism of a weaving loom comprising, a bushing having an outer wall defining a bore, a clamp having two branch elements approximately parallel with respect to each other and extending on opposite sides of an axis of symmetry taken along said clamp, a crosspiece for connecting said branch elements, each branch element having a first hooked end oriented outwardly with respect to said axis of said symmetry and a second end including a jaw element extending inwardly with respect to said axis of symmetry and an intermediate portion spaced between said first and second ends, a projection disposed along each of said intermediate portions and extending outwardly with respect to said axis of symmetry, and adhesive means for securing the cords intermediate said branch elements and adjacent said second ends thereof.

11. The device of claim 10, including a handle means extending from said bushing, said handle means including a pair of spaced portions, a projecting lug extending outwardly from each of said spaced portions.

12. The device of claim 11, including a plate means having an opening therein, said opening being of a first dimension, said bushing being of a size to be inserted through said opening, said lugs having contact surfaces for engaging said plate means on opposite sides of said opening whereby said lugs support said bushing within said opening.

13. The device of claim 12, wherein said spaced portions of said handle means are resiliently yieldable toward one another so that upon application of force applied to compress said spaced portions towards one another said lug means are drawn inwardly so as to pass through said opening in said plate means.

* * * * *